United States Patent [19]

Charlot, Jr.

[11] Patent Number: 4,523,356

[45] Date of Patent: Jun. 18, 1985

[54] BALL CLUTCH MECHANISM WITH TWO SETS OF BALLS IN SEPARATE RADIAL PLANES

[75] Inventor: Lincoln H. Charlot, Jr., Tampa, Fla.

[73] Assignee: Security Tag Systems, Inc., St. Petersburg, Fla.

[21] Appl. No.: 584,121

[22] Filed: Feb. 27, 1984

[51] Int. Cl.[3] ..... A44B 9/00; G08B 13/00

[52] U.S. Cl. ..... 24/155 BR; 24/150 R; 24/155 R

[58] Field of Search ..... 24/155 BR, 155 R, 150 R, 24/108, 562

[56] References Cited

U.S. PATENT DOCUMENTS

| | | | |
|---|---|---|---|
| 346,784 | 8/1886 | Stanford | 24/155 BR |
| 1,053,883 | 2/1913 | Sheppard | 24/155 BR |
| 1,089,755 | 3/1914 | Fischer . | |
| 1,409,815 | 3/1922 | Belknap . | |
| 1,472,681 | 10/1923 | Roy . | |
| 2,826,855 | 3/1958 | Troccia | 43/44.83 |
| 3,858,280 | 1/1975 | Martens | 24/150 R |
| 3,911,534 | 10/1975 | Martens et al. | 24/150 R |
| 3,974,581 | 8/1976 | Martens et al. | 40/20 R |
| 4,221,025 | 9/1980 | Martens | 24/150 R |

*Primary Examiner*—Victor N. Sakran

*Attorney, Agent, or Firm*—Baker, Maxham, Callan & Jester

[57] ABSTRACT

A ball clutch mechanism for restraining a pin from longitudinal movement, including an anvil, a radially symmetrical cup, a spring and two two-ball sets of uniformly dimensioned balls. The anvil has an axial bore for axially receiving the pin. The cup has a confining end, a tapered interior wall and a predominantly open end covering the anvil and axially aligned with the anvil for axially receiving a pin that is axially received by the bore of the anvil. The anvil is longitudinally movable along its bore axis with respect to the cup. The spring forces the anvil toward the confining end of the cup. The first set of balls engages the anvil and is forced by the anvil toward the confining end of the cup by the spring. The second set of balls is in the extreme confining end of the cup for clutching the pin. The interior wall of the cup is dimensioned and tapered with respect to the balls to cause the balls of the first and second sets to be in different radial planes and to cause the balls of the second set to contact the pin. When the balls of the first set are forced toward the confining end of the cup, the balls of the first set wedge the balls of the second set between the tapered interior wall of the cup and the pin and uniformly space the balls of the second set to apply symmetrical radial pressure against the pin to firmly clutch the pin and thereby restrain the pin from longitudinal movement.

18 Claims, 4 Drawing Figures

BALL CLUTCH MECHANISM WITH TWO SETS OF BALLS IN SEPARATE RADIAL PLANES

BACKGROUND OF THE INVENTION

The present invention is directed to an improvement in ball clutch mechanisms for restraining a pin from longitudinal movement.

Ball clutch mechanisms are commonly used with pins for attaching items together. One such use is in the electronic article surveillance field wherein tags that can be sensed electronically include a ball clutch mechanism for enabling the tag to be attached to an article of merchandise by inserting a pin through the article and into the ball clutch mechanism of the tag. Ball clutch mechanisms for such a tag are described in U.S. Pat. Nos. 4,221,025 to Martens and Vanderbult; 3,911,534 to Martens and Vanderbult and 3,858,280 to Martens.

The ball clutch mechanism described in U.S. Pat. No. 4,221,025 is presently in commerical use. Basically, such ball clutch mechanism includes an anvil having an axial bore for axially receiving the pin; a generally radially symmetrical cup having a confining end with a small axial opening therein for admitting the pin, a tapered interior wall and a predominantly open end covering the anvil and axially aligned with the anvil for axially receiving the pin that passes therethrough and into the bore of the anvil, wherein the anvil is longitudinally movable along its bore axis with respect to the cup; a spring for forcing the anvil toward the closed end of the cup; and a set of uniformly dimensioned balls in the cup, engaging the anvil and forced by the anvil toward the confining end of the cup to clutch the pin when the anvil is forced toward the confining end of the cup by the spring. The interior wall of the cup is dimensioned and tapered with respect to the balls such that when the anvil is forced toward the confining end of the cup, the balls are wedged between the tapered interior wall of the cup and the pin to apply radial pressure against the pin to clutch the pin for restraining the pin from longitudinal movement. The pin is released from the ball clutch mechanism through use of a detaching tool described in U.S. Pat. No. 3,911,534. Such tool includes an electromagnetic for drawing the anvil (which is made of magnetic material) of the ball clutch mechanism against the force of the spring to thereby release the balls from the tapered wall at the confining end of the cup and remove the radial pressure applied to the pin.

To prevent inadvertent release of the pin it is necessary that the balls maintain symmetrical radial pressure on the pin. In an attempt to so provide such symmetrical radial pressure on the pin, the ball clutch mechanism described in U.S. Pat. No. 4,221,025 includes rigid mechanical apparatus for uniformly spacing the balls and for precluding annular movement of the balls when the pin is inserted into the ball clutch mechanism. In alternative embodiments described therein such apparatus consists of (1) radially extending open channels on the surface of the anvil that engages the balls, through which channels the balls can freely pass for engaging the interior side wall of the cup; (2) a plurality of longitudinally radially inwardly directed and uniformly spaced projections formed on the interior wall of the cup; (3) uniformly spaced flanges extending from the periphery of a washer positioned between the anvil and the balls; and (4) uniformly spaced flanges extending from the periphery of the anvil and defining channels therebetween through which the balls travel for engagement with the interior wall of the cup. Such rigid mechanical apparatus achieve the desired result only when they are constructed in accordance with extremely tight manufacturing tolerances so as to be precisely symmetrical. In practice the commercial embodiments are not always symmetrical; and as a result the pressure applied to the pin by the balls is not symmetrical and the pin releases from the ball clutch mechanism inadvertently.

SUMMARY OF THE INVENTION

The ball clutch mechanism of the present invention does not use such rigid mechanical apparatus that preclude annular movement of the balls to achieve the application of symmetrical radial pressure on the pin, but instead achieves such result by utilizing an additional set of uniformly dimensioned balls interposed in a separate radial plane between the anvil and the set of balls that is wedged between the pin and the interior walls at the confining end of the cup. All of the balls are freely movable annularly within the cup when the pin is inserted into the ball clutch mechanism so that the set of balls in the radial plane adjacent the anvil uniformly seats symmetrically with the balls adjacent the confining end of the cup to wedge the latter set of balls between the pin and the tapered interior wall of the cup and to uniformly space the latter set of balls to apply symmetrical radial pressure against the pin to firmly clutch the pin and thereby restrain the pin from longitudinal movement. The additional set of balls also provides a more uniform surface for effecting symmetrical spacing than do the rigid mechanical apparatus of the prior art ball clutch mechanism described above. In essence, the ball clutch mechanism of the present invention includes an anvil having an axial bore for axially receiving a pin; a radially symmetrical cup having a confining end, a tapered interior wall and a predominantly open end covering the anvil and axially aligned with the anvil for axially receiving a pin that is axially received by the bore of the anvil, wherein the anvil is longitudinally movable along its bore axis with respect to the cup; biasing means, such as a spring, for forcing the anvil toward the confining end of the cup; a first set of a given number of uniformly dimensioned balls in the cup, engaging the anvil and forced by the anvil toward the confining end of the cup when the anvil is forced toward the confining end of the cup by the biasing means; and a second set of the given number of uniformly dimensioned balls in the extreme confining end of the cup for clutching a pin axially received by the cup and the bore of the anvil. The interior wall of the cup is dimensioned and tapered with respect to the balls to cause the balls of the first and second sets to be in different radial planes and to cause the balls of the second set to contact the pin. When the balls of the first set are forced toward the confining end of the cup, the balls of the first set wedge the balls of the second set between the tapered interior wall of the cup and the pin and uniformly space the balls of the second set to apply symmetrical radial pressure against said pin to firmly clutch the pin and thereby restrain the pin from longitudinal movement.

It is preferable that the first set of balls, which engage the anvil, be prevented from touching the pin. In the preferred embodiment this is accomplished by shaping the anvil surface that engages these balls to have a uniform outward concave contour. If the first set of balls touches the pin, the clutching pressure applied by the second set of balls in the confining end of the cup is diminished.

It also is preferable that all of the balls be uniformly dimesioned so as to preclude a dissymetry resulting from some of the balls possibly being transposed between sets when the anvil is drawn away from the confining end of the cup by the detaching tool and the pin is released from the mechanism.

In addition, it is preferable that the pin include one or more circumferential notches for engaging the set of balls that clutches the pin. These notches provide the user of the ball clutch mechanism with a sense of pin insertion depth and enhance the clutch of the second set of balls on the pin.

Additional features of the present invention are described in the description of the preferred embodiment.

DESCRIPTION OF THE PREFERRED EMBODIMENT

Figure 1:
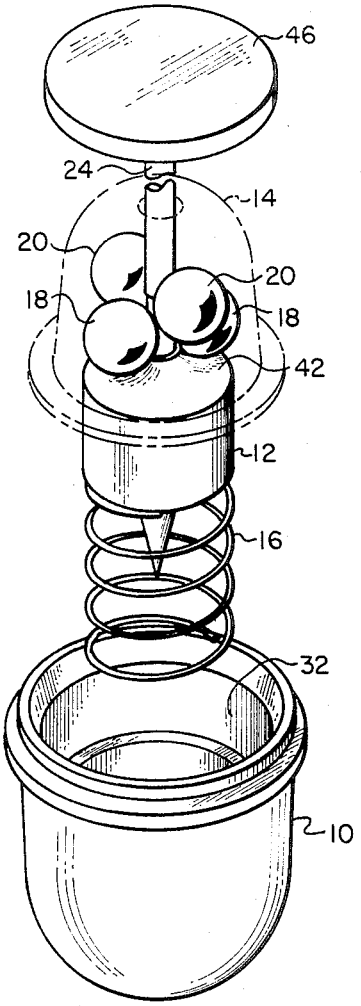
FIG. 1 is a partially exploded perspective view of the ball clutch mechanism of the present invention, with the cup shown in phantom lines.
Figure 2:
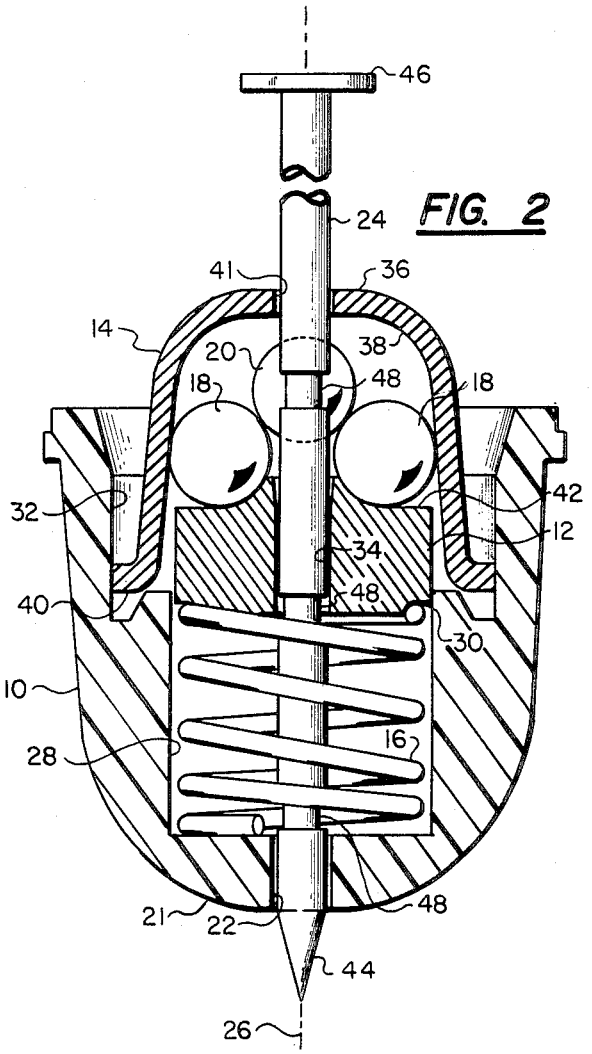
FIG. 2 is a cross-sectional view of the ball clutch mechanism taken along a plane through the vertical axis of the mechanism.
Figure 3:
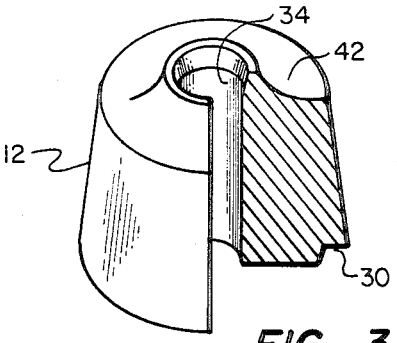
FIG. 3 is a quarter-sectional perspective view of the anvil of the ball clutch mechanism.
Figure 4:
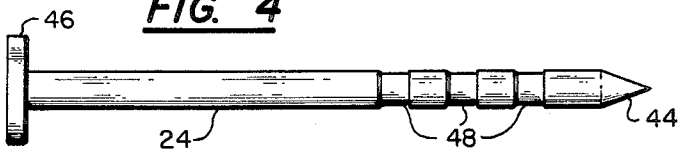
FIG. 4 is a side plan view of the pin used with the ball clutch mechanism.

Referring to the Drawing, the preferred embodiment of the ball clutch mechanism of the present invention includes a housing 10 that contains an anvil 12, a cup 14, a spring 16, a first set of two balls 18 and a second set of two balls 20. All of the balls 18, 20 are uniformly dimensioned.

The interior of the housing 10 is symmetrical. The housing 10 has a substantially confining end 21 and includes a small axial bore 22 in the confining end 21 for admitting a pin 24 longitudinally along the axis 26 of the bore 22.

Communicating with the small bore 22 is a larger axial bore 28 along the axis 26. The larger axial bore 28 contains the spring 16, which is disposed to exert force longitudinally along the common axis 26. One end of the spring 16 is supported by the confining end 21 of the housing 10 and the other end of the spring 16 engages a spring guide 30 at the periphery of the anvil 12.

The anvil 12 is made of a magnetic material which can be attracted by an electromagnet so as to draw the anvil 12 against the force of the spring 16 toward the confining end 21 of the housing 10. The anvil 12 is generally cylindrical and is dimensioned radially to closely fit within the larger bore 28 of the housing 10.

The housing 10 has a still larger axial bore 32 communicating with the large bore 28 along the common axis 26. The still larger bore 32 contains the cup 14.

The anvil 12 has an axial bore 34 for axially receiving the pin 24 along the common axis 26.

The cup 14 is radially symmetrical. The cup 14 has a confining end 36, a tapered interior wall 38 and a predominantly open end 40 covering the anvil 12. The cup 14 has a small axial opening 41 in its confining end 36 and is axially aligned with the anvil along the common axis 26 for axially receiving the pin 24. The cup 14 is made of stainless steel.

The anvil 12 is longitudinally movable along the common axis 26 with respect to the cup 14. The spring 16 is positioned for forcing the anvil 12 toward the confining end 36 of the cup 14.

The first set of balls 18 engage the anvil 12 and are forced by the anvil 12 toward the confining end 36 of the cup by the spring 16.

The second set of balls 20 is positioned in the extreme confining end 36 of the cup 14 for clutching the pin 24. The interior wall 38 of the cup 14 is dimensioned and tapered with respect to the balls 18, 20 to cause the balls 18 of the first set to be in a different radial plane from the balls 20 of the second set and to cause the balls 20 of the second set to contact the pin 24. When the balls 18 of the first set are forced toward the confining end 36 of the cup 14 by the force of the spring 16 on the anvil 12, the balls 18 of the first set wedge the balls 20 of the second set between the tapered interior wall 38 of the cup 14 and the pin 24 and uniformly space the balls 20 of the second set to apply symmetrical radial pressure against the pin 24 to firmly clutch the pin 24 and thereby restrain the pin 24 from longitudinal movement. All of the balls 18, 20 are stainless steel ball bearings.

The mechanism of the present invention enables symmetrical radial to be applied to the pin 24 by only two balls 20 and thereby enables maximum radial pressure to be applied in proportion to the longitudinal force applied by the spring 16.

The surface 42 of the anvil 12 that engages the first set of balls 18 is shaped to have a uniform outward concave contour in order to prevent the balls 18 of the first set from touching the pin 24 when the anvil 12 is forced toward the confining end 36 of the cup 14. The contour of the concave surface 42 has the same radius as the balls 18 of the first set.

The pin 24 has a point 44 and a head 46 for enabling the ball clutch mechanism to be attached to an article by inserting the pointed end 44 of the pin through the article, through the small opening 41 in the cup 14 and into the bore 34 of the anvil 12. The pin 24 includes circumferential notches 48 for engaging the second set of balls 20 when the pin 24 is inserted into the anvil bore 34. The notches 48 provide the user of the ball clutch mechanism with a sense of pin insertion depth and enhance the clutch of the second set of balls 20 on the pin 24. The pin 24 is made of stainless steel.

I claim:

1. A ball clutch mechanism for restraining a pin from longitudinal movement, comprising an anvil having an axial bore for axially receiving a pin;

a radially symmetrical cup having a confining end, a tapered interior wall and a predominantly open end covering the anvil and axially aligned with the anvil for axially receiving a said pin that is axially received by the bore of the anvil, wherein the anvil is longitudinally movable along its bore axis with respect to the cup;

biasing mean for forcing the anvil toward the confining end of the cup;

a first set of a given number of uniformly dimensioned balls in the cup, engaging the anvil and forced by the anvil toward the confining end of the cup when the anvil is forced toward the confining end of the cup by the biasing means; and a second set of the given number of uniformly dimensioned balls in the extreme confining end of the cup for clutching a said pin axially received by the cup and the bore of the anvil, wherein the interior wall of the cup is dimensioned and tapered with respect to the balls to cause the balls of the first and second sets to be in different radial planes and to cause the balls of the second set to contact the pin and wherein when the balls of the first set are forced toward the confining end of the cup, the balls of the first set wedge the balls of the second set between the tapered interior wall of the cup and the pin and uniformly space the balls of the second set to apply symmetrical radial pressure against said pin to firmly clutch the pin and thereby restrain said pin from longitudinal movement.

2. A mechanism according to claim 1, comprising means for preventing the balls of the first set from touching said pin when the anvil is forced toward the confining end of the cup.

3. A mechanism according to claim 2, wherein the anvil is shaped for preventing the balls of the first set from touching said pin when the anvil is forced toward the confining end of the cup.

4. A mechanism according to claim 2, wherein there are only two balls in each set.

5. A mechanism according to claim 1, wherein there are only two balls in each set.

6. A mechanism according to claim 5, wherein all of the balls are uniformly dimensioned.

7. A mechanism according to claim 1, wherein all of the balls are uniformly dimensioned.

8. A mechanism according to claim 7, comprising means for preventing the balls of the first set from touching said pin when the anvil is forced toward the confining end of the cup.

9. A mechanism according to claim 8, further comprising a said pin for insertion through said bore, wherein the pin has a point and a head for enabling the mechanism to be attached to an article by inserting the pointed end of the pin through the article and into said bore, and wherein the pin includes a circumferential notch for engaging the second set of balls when the pin is inserted into said bore for providing a user of the mechanism with a sense of pin insertion depth and to enhance said clutch of the second set of balls on the pin.

10. A mechanism according to claim 1, further comprising a said pin for insertion through said bore, wherein the pin has a point and a head for enabling the mechanism to be attached to an article by inserting the pointed end of the pin through the article and into said bore.

11. A mechanism according to claim 10, wherein the pin includes a circumferential notch for engaging the second set of balls when the pin is inserted into said bore for providing a user of the mechanism with a sense of pin insertion depth and to enhance said clutch of the second set of balls on the pin.

12. A mechanism according to claim 11 wherein the pin includes a plurality of said circumferential notches.

13. A mechanism according to claim 11, comprising means for preventing the balls of the first set from touching said pin when the anvil is forced toward the confining end of the cup.

14. A mechanism acording to claim 13, wherein the anvil is shaped for preventing the balls of the first set from touching said pin when the anvil is forced toward the confining end of the cup.

15. A mechanism according to claim 13, wherein there are only two balls in each set.

16. A mechanism according to claim 11, wherein there are only two balls in each set.

17. A mechanism according to claim 16, wherein all of the balls are uniformly dimensioned.

18. A mechanism according to claim 4, wherein all of the balls are uniformly dimensioned.

* * * * *